US011376847B2

(12) United States Patent
Murata

(10) Patent No.: US 11,376,847 B2
(45) Date of Patent: Jul. 5, 2022

(54) LIQUID DROPLET EJECTION DEVICE AND LIQUID DROPLET EJECTION METHOD

(71) Applicant: SIJTechnology, Inc., Tsukuba (JP)

(72) Inventor: Kazuhiro Murata, Tsukuba (JP)

(73) Assignee: SIJTECHNOLOGY, INC., Tsukuba (JP)

( * ) Notice: Subject to any disclaimer, the term of this patent is extended or adjusted under 35 U.S.C. 154(b) by 0 days.

(21) Appl. No.: 17/092,408

(22) Filed: Nov. 9, 2020

(65) Prior Publication Data

US 2021/0053345 A1 Feb. 25, 2021

Related U.S. Application Data

(63) Continuation of application No. PCT/JP2020/010368, filed on Mar. 10, 2020.

(30) Foreign Application Priority Data

Apr. 25, 2019 (JP) ..... JP2019-084568

(51) Int. Cl.
*B41J 2/045* (2006.01)
*B41J 2/14* (2006.01)

(52) U.S. Cl.
CPC ..... *B41J 2/04576* (2013.01); *B41J 2/04541* (2013.01); *B41J 2/14201* (2013.01)

(58) Field of Classification Search
CPC ..... B41J 2/04576; B41J 2/04541; B41J 2/14201; B41J 2/06; B41J 2/2114;
(Continued)

(56) References Cited

U.S. PATENT DOCUMENTS

2006/0125363 A1 6/2006 Tahira et al.
2006/0223316 A1 10/2006 Baik et al.
(Continued)

FOREIGN PATENT DOCUMENTS

CN 1701641 A 11/2005
CN 1832858 A 9/2006
(Continued)

OTHER PUBLICATIONS

IP.com search (Year: 2021).*
(Continued)

*Primary Examiner* — Lisa Solomon
(74) *Attorney, Agent, or Firm* — The Marbury Law Group, PLLC

(57) ABSTRACT

A liquid droplet ejection device includes a first liquid droplet ejection unit including a first liquid holding unit configured to hold a first liquid and a first tip configured to eject a first liquid of the first liquid holding unit as a first liquid droplet, a second liquid droplet ejection unit including a second liquid holding unit configured to hold a second liquid and a second configured tip to eject the second liquid of the second liquid holding unit as a second liquid droplet differing from the first liquid droplet, an object holding unit configured to hold an object the first liquid and the second liquid being ejected to the object, and a driving unit configured to move the first tip and the second tip in a first direction relative to the object holding unit, and the first tip is arranged in the first direction relative to the second tip.

13 Claims, 12 Drawing Sheets

(58) Field of Classification Search
CPC .. B41J 25/001; B41J 2/01; B05C 5/00; B05C 9/06; B05D 1/26; B05D 1/36
See application file for complete search history.

(56) References Cited

U.S. PATENT DOCUMENTS

| | | | |
|---|---|---|---|
| 2006/0262163 | A1 | 11/2006 | Nishio et al. |
| 2007/0111626 | A1 | 5/2007 | Kato |
| 2008/0151006 | A1 | 6/2008 | Nishio et al. |
| 2009/0122110 | A1 | 5/2009 | Yoshioka |
| 2010/0209614 | A1 | 8/2010 | Sakata et al. |
| 2010/0259582 | A1 | 10/2010 | Miyakoshi |

FOREIGN PATENT DOCUMENTS

| | | | |
|---|---|---|---|
| CN | 101428497 | A | 5/2009 |
| JP | 10-34967 | A | 2/1998 |
| JP | 2002-170484 | A | 6/2002 |
| JP | 2007-136330 | A | 6/2007 |
| JP | 2007-152339 | A | 6/2007 |
| JP | 2008-087457 | A | 4/2008 |
| JP | 2010-188264 | A | 9/2010 |
| KR | 10-2006-0105111 | A | 10/2006 |
| WO | 2009/057464 | A1 | 5/2009 |
| WO | 2009/075147 | A1 | 6/2009 |

OTHER PUBLICATIONS

Written Opinion of the International Searching Authority in PCT/JP2020/010368 dated Jun. 2, 2020.

Office Action First Notice of Reason for Refusal issued in Chinese Application No. 202080002905.6 dated Sep. 28, 2021.

International Search Report from the Japan Patent Office in International Application No. PCT/JP2020/010368 dated Jun. 2, 2020.

International Search Authority from the Japan Patent Office in International Application No. PCT/JP2020/010368 dated Jun. 2, 2020.

Office Action issued in related Korean Application No. 10-2020-7032371 dated Dec. 26, 2021.

Korean Patent Intellectural Property Office, Notice of Allowance issued in Korean Patent Application No. 10-2020-7032371 and English-language translation, dated Mar. 4, 2022 (3 pages).

* cited by examiner

LIQUID DROPLET EJECTION DEVICE AND LIQUID DROPLET EJECTION METHOD

CROSS REFERENCE TO RELATED APPLICATIONS

This application is a continuation application (bypass route) based upon PCT/JP2020/010368 filed on Mar. 10, 2020 and claims the benefit of priority to Japanese Patent Application No. 2019-084568 filed on Apr. 25, 2019, the entire contents of which are incorporated herein by reference.

FIELD

The present disclosure relates to a liquid droplet ejection device and a liquid droplet ejection method.

BACKGROUND

In recent years, inkjet printing technology has been applied to industrial processes. For example, a color filter manufacturing process for a liquid crystal display is an example. As an inkjet printing technique, a so-called piezo type head, which ejects a liquid droplet by mechanical pressure or vibration, has been conventionally used, but an electrostatic ejection type inkjet heads, which can eject a finer liquid droplet, is drawing attention. Japanese Unexamined Patent Application Publication No. H10-34967 discloses an electrostatic ejection type inkjet recording device.

SUMMARY

According to an embodiment of the present disclosure, a liquid droplet ejection device includes at least one first liquid droplet ejection unit including a first liquid holding unit and a first tip, the first liquid holding unit configured to hold a first liquid, and the first tip configured to eject a first liquid in the first liquid holding unit as a first liquid droplet onto an object; at least one second liquid droplet ejection unit including a second liquid holding unit and a second tip, the second liquid holding unit configured to hold a second liquid, and the second tip configured to eject the second liquid in the second liquid holding unit as a second liquid droplet differing from the first liquid droplet onto the object; an object holding unit configured to hold the object; and a driving unit configured to move the first tip and the second tip in a first direction relative to the object holding unit. The first tip is arranged in the first direction relative to the second tip.

In the above liquid droplet ejection device, the at least one first liquid droplet ejection unit includes a plurality of first liquid droplet ejection units arranged in a direction intersecting with respect to a direction in which the first liquid droplet ejection unit moves.

In the above liquid droplet ejection device, the at least one first liquid droplet ejection unit extends in a direction intersecting with respect to a direction in which the at least one first liquid droplet ejection unit moves.

In the above liquid droplet ejection device, the at least one second liquid droplet ejection unit includes a plurality of second liquid droplet ejection units arranged in a direction intersecting with respect to a direction in which the at least one first liquid droplet ejection unit moves.

In the above liquid droplet ejection device, an inner diameter of the first tip in the at least one first liquid droplet ejection unit is larger than an inner diameter of the second tip in the at least one second liquid droplet ejection unit.

In the above liquid droplet ejection device, the at least one first liquid droplet ejection unit has a piezo type nozzle head, and the at least one second liquid droplet ejection unit has an electrostatic ejection type nozzle head.

According to an embodiment of the present disclosure, a liquid droplet ejection method includes ejecting a first liquid droplet for surface treatment from a first liquid droplet ejection unit onto a first region of an object; ejecting a second liquid droplet for forming a pattern from a second liquid droplet ejection unit onto the first region, the second liquid droplet being more viscous than the first liquid droplet, and the second liquid droplet ejection unit different from the first liquid droplet ejection unit; and ejecting the first liquid droplet from the first liquid droplet ejection unit onto a second region in synchronized with ejecting the second liquid droplet from the second liquid droplet ejection unit, the second region being different from the first region.

In the above liquid droplet ejection method, the second liquid droplet is ejected in a response to a predetermined condition being satisfied.

In the above liquid droplet ejection method, the predetermined condition includes an information related to an elapsed time after the first liquid droplet was ejected to the first region, or an information related to a thickness of the first liquid droplet.

In the above liquid droplet ejection method, the region in which the first liquid droplet is ejected is larger than a pattern size formed by the second liquid droplet.

In the above liquid droplet ejection method, the pattern size formed by the second liquid droplet is 100 nm or more and 500 μm or less.

In the above liquid droplet ejection method, the first liquid droplet has volatility.

In the above liquid droplet ejection method, a surface resistance of the first liquid droplet is $10^6\Omega$/sq or more and $10^{11}\Omega$/sq or less.

By using an embodiment of the present disclosure, it is possible to eject liquid droplets easily and stably onto the object surface.

DESCRIPTION OF EMBODIMENTS

Figure 1:
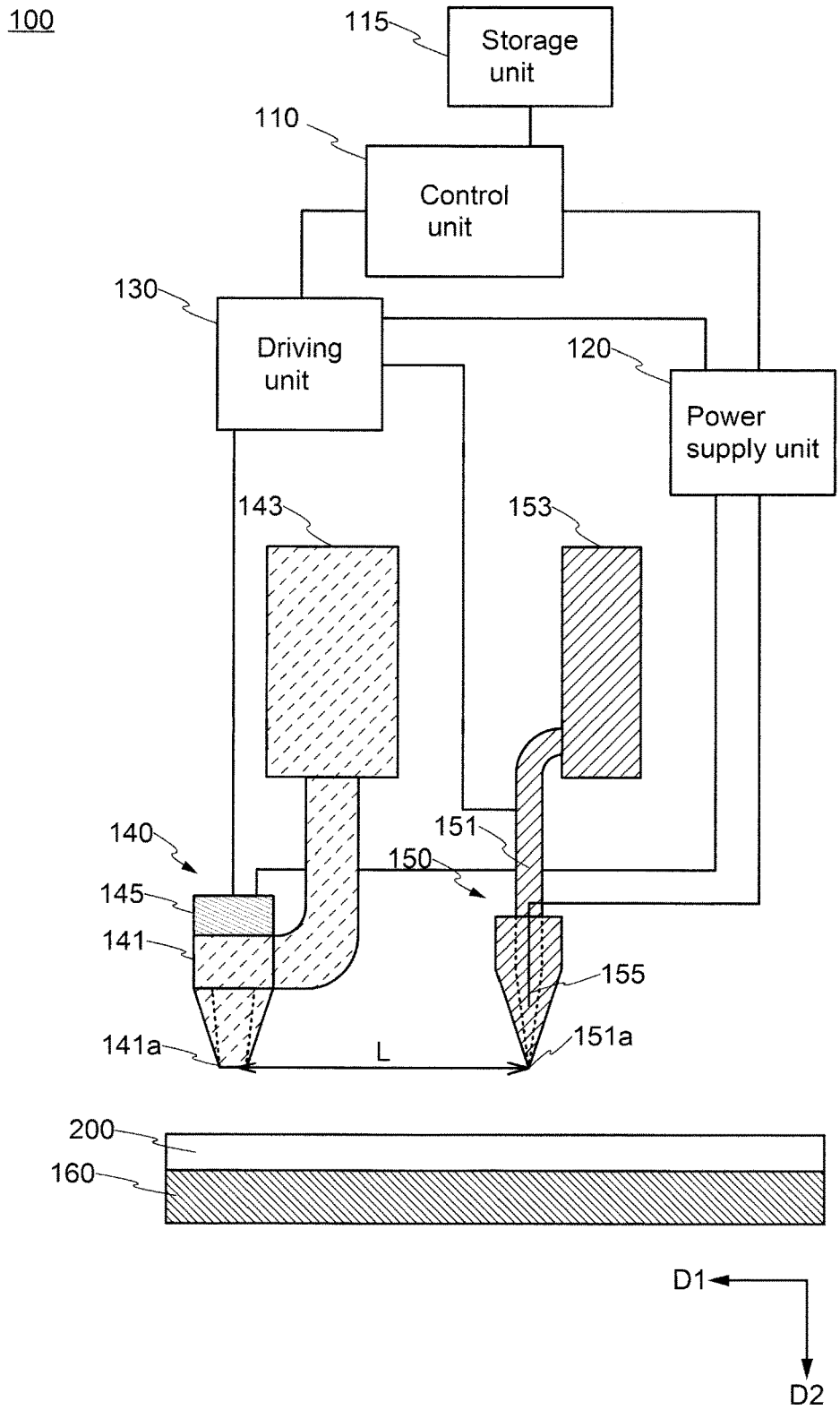
FIG. 1 is a schematic view of a liquid droplet ejection device according to an embodiment of the present disclosure.

Hereinafter, embodiments of the present disclosure disclosed in the present application will be described with reference to the drawings. However, the present disclosure can be implemented in various forms without departing from the gist thereof, and should not be construed as being limited to the description of the following exemplary embodiments.

In the drawings referred to in the present exemplary embodiments, the same portions or portions having similar functions are denoted by the identical signs or similar signs (signs each formed simply by adding A, B, etc. to the end of a number), and a repetitive description thereof may be omitted. For the convenience of description, the dimensional ratio of the drawings may be different from the actual ratio, or a part of the configuration may be omitted from the drawings.

Furthermore, in the detailed description of the present disclosure, in defining the positional relationship between one component and another, the terms "above" and "below" include not only the case of being positioned directly above or below one component, but also the case of interposing another component therebetween, unless otherwise specified.

In the case of the electrostatic ejection type inkjet head, there are cases in which it is difficult to eject the ink due to the electrostatic charging of an object, or the ink does not land at a desired position because it is affected by the effect of the electric field strength distributions due to an unevenness on the object.

In particular, in the case of the charging of the object itself or the pattern applied to the object affects the charging, or in the case of there is a difference of the energy between the pattern surface and the object surface, the ink may not fit well.

The present disclosure is to eject liquid droplets easily and stably onto an object surface.

First Embodiment

[1-1. Configuration of Liquid Droplet Ejection Device 100]

FIG. 1 is a schematic view of a liquid droplet ejection device 100 according to an embodiment of the present disclosure.

The liquid droplet ejection device 100 includes a control unit 110, a storage unit 115, a power supply unit 120, a driving unit 130, a first liquid droplet ejection unit 140, a second liquid droplet ejection unit 150, and an object holding unit 160.

The control unit 110 includes CPU (Central Processing Unit), ASIC (Application Specific Integrated Circuit), FPGA (Field Programmable Gate Array), or other calculation processing circuitry. The control unit 110 controls the ejection processes of the first liquid droplet ejection unit 140 and the second liquid droplet ejection unit 150 by using preset liquid droplet ejection programs.

The control unit 110 controls an ejection timing of a first liquid droplet 147 (see FIG. 3) from the first liquid droplet ejection unit 140 and an ejection timing of the second liquid droplet 157 (see FIG. 5) of the second liquid droplet ejection unit 150. As described in detail later, the ejection of the first liquid droplet 147 by the first liquid droplet ejection unit 140 and the ejection of the second liquid droplet 157 by the second liquid droplet ejection unit 150 are synchronized with each other. "Synchronizing" in the present embodiment means that the first liquid droplet 147 and the second liquid droplet 157 are ejected at a prescribed time period. In this example, the first liquid droplet 147 and the second liquid droplet 157 are ejected simultaneously. The control unit 110 controls the second liquid droplet ejection unit 150 to eject the second liquid droplet 157 in the first region when the first liquid droplet ejection unit 140 moves from the first region of an object 200 to the second region of the object 200, on which the first liquid droplet 147 is ejected.

The storage unit 115 has a function as a data base for storing a liquid droplet ejecting program and various types of data used in the liquid droplet ejecting program. Memories, SSDs, or storable elements are used for the storage unit 115.

The power supply unit 120 is connected to the control unit 110, the driving unit 130, the first liquid droplet ejection unit 140, and the second liquid droplet ejection unit 150. The power supply unit 120 applies a voltage to the first liquid droplet ejection unit 140 and the second liquid droplet ejection unit 150 based on a signal input from the control unit 110. In this example, the power supply unit 120 applies a pulsed voltage to the second liquid droplet ejection unit 150. The voltage is not limited to the pulse voltage, and a constant voltage may be applied at all times.

The driving unit 130 includes a driving member such as a motor, a belt, and a gear. Based on an instruction from the control unit 110, the driving unit 130 moves the first liquid droplet ejection unit 140 and the second liquid droplet ejection unit 150 (more specifically, a nozzle tip 141*a* of a first liquid droplet nozzle 141 and a nozzle tip 151*a* of a second liquid droplet nozzle 151 described later) in one direction (in this example, first direction D1) with respective to the object holding unit 160.

The first liquid droplet ejection unit 140 includes the first liquid droplet nozzle 141 and a first ink tank 143 (also referred to as a first liquid holding unit). In this embodiment, a piezo type ink jet nozzle is used as the first liquid droplet nozzle 141. A piezoelectric element 145 is provided at the top of the first liquid droplet nozzle 141. The piezoelectric element 145 is electrically connected to the power supply unit 120. The piezoelectric element 145 ejects the first liquid droplet 147 from the nozzle tip 141*a* (also referred to as a first tip) of the first liquid droplet nozzle 141 with the first liquid held in the first ink tank 143 by pressing the first liquid droplet 147 by the voltage applied from the power supply unit 120.

The first liquid droplet nozzle 141 in the first liquid droplet ejection unit 140 is provided perpendicularly to the front face of the object 200.

The inner diameter of the nozzle tip 141*a* in the first liquid droplet nozzle 141 is desirably larger than the inner diameter of the nozzle tip 151*a* in the second liquid droplet nozzle 151. This makes it possible to eject the first liquid droplet 147 in a wide region while suppressing clogging of the nozzle.

The second liquid droplet ejection unit 150 includes the second liquid droplet nozzle 151 and a second ink tank 153 (also referred to as a second liquid holding unit). An electrostatic ejection type inkjet nozzle is used for the second liquid droplet nozzle 151. The inner diameter of the nozzle tip 151*a* in the second liquid droplet nozzle 151 is several hundred nanometers or more and 20 μm or less, preferably 1 μm or more and 15 μm or less, more preferably 5 μm or more and 12 μm or less.

The second liquid droplet nozzle 151 has a glass tube, and an electrode 155 is provided inside the glass tube. In this example, a fine wire formed of tungsten is used as the electrode 155. The electrode 155 is not limited to tungsten, and nickel, molybdenum, titanium, gold, silver, copper, platinum, or the like may be provided.

The electrode 155 in the second liquid droplet nozzle 151 is electrically connected to the power supply unit 120. The second liquid held in the second ink tank 153 is ejected as a second liquid droplet 157 (see FIG. 5) from the nozzle tip 151*a* (also referred to as a second tip) of the second liquid droplet nozzle 151 by voltages (in this example, 1000V) applied from the power supply unit 120 to the inside of the second liquid droplet nozzle 151 and the electrode 155. By controlling the voltage applied from the power supply unit 120, the shapes of the liquid droplet (patterns) formed by the second liquid droplet 157 can be controlled.

The first liquid droplet ejection unit 140 and the second liquid droplet ejection unit 150 are arranged along a direction in which the first liquid droplet ejection unit 140 and the second liquid droplet ejection unit 150 move relative to the object holding unit 160 (in this example, the direction D1). Specifically, the first liquid droplet ejection unit 140 (specifically, the nozzle tip 141*a* of the first liquid droplet nozzle 141) is arranged in front of the second liquid droplet ejection unit 150 (specifically, the nozzle tip 151*a* of the second liquid droplet nozzle 151) with respect to the directions in which the first liquid droplet ejection unit 140 and the second liquid droplet ejection unit 150 move. The distances L between the first liquid droplet ejection unit 140 and the second liquid droplet ejection unit 150 can be appropriately adjusted.

The object holding unit 160 has a function of holding the object 200. For the object holding unit 160, a stage is used in this instance. The mechanism by which the object holding unit 160 holds the object 200 is not particularly limited, and a common holding mechanism is used. In this example, the object 200 is vacuum-adsorbed to the object holding unit 160. In addition, it is not limited thereto, the object holding unit 160 may hold the object 200 using a fixture.

[1-2. Liquid Droplet Ejection Method]

Next, a liquid droplet ejection method is described with reference to the drawings.

Figure 2:
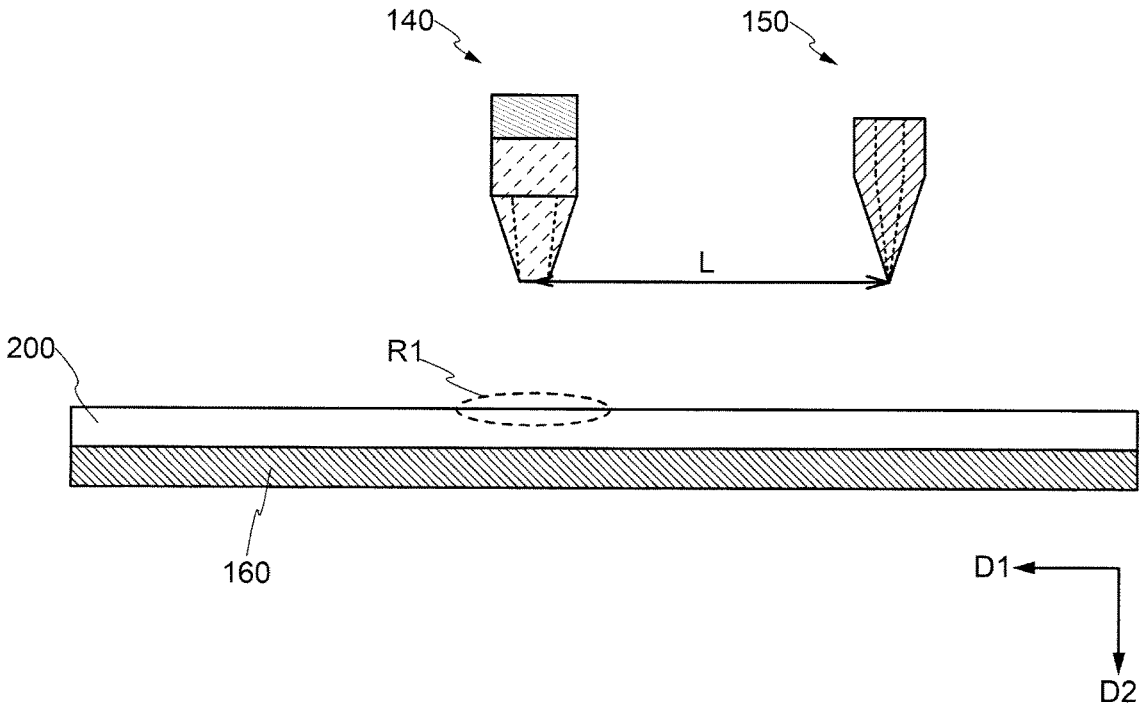
FIG. 2 is a cross-sectional view of a liquid droplet ejection method according to an embodiment of the present disclosure.

First, the first liquid droplet ejection unit 140 and the second control unit 150 move onto the object 200 prepared in the liquid droplet ejection device 100 by the control unit 110 and the driving unit 130. At this time, as shown in FIG. 2, the first liquid droplet ejection unit 140 is arranged on the first region R1 of the object 200 at a certain distance from the surface of the first region R1.

The object 200 refers to a member in which the first liquid droplet 147 and the second liquid droplet 157 are ejected. In this embodiment, a flat glass plate is used for the object 200. The object 200 is not limited to the flat glass plate. For example, the object 200 may be a metallic plate or an organic member. The object 200 may include a counter electrode for the liquid droplet ejection.

Figure 3:
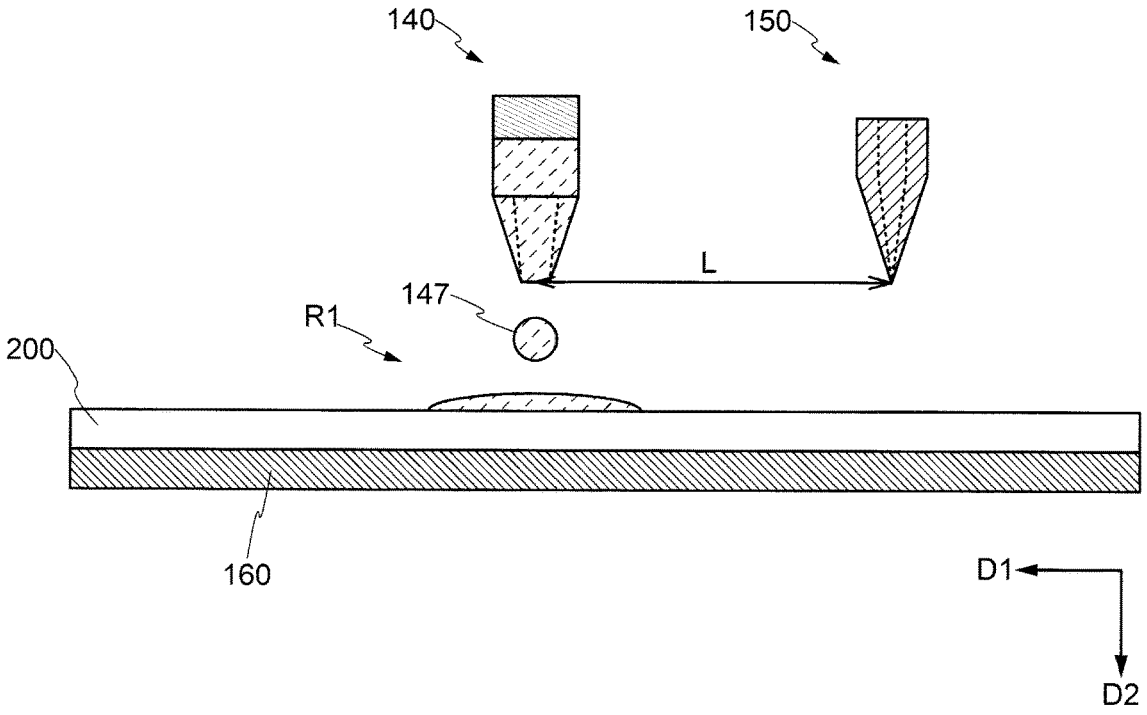
FIG. 3 is a cross-sectional view of a liquid droplet ejection method according to an embodiment of the present disclosure.

Next, as shown in FIG. 3, the first liquid droplet ejection unit 140 ejects the first liquid droplet 147 to the first region R1.

Surface treatment liquid is used for the first liquid droplet 147. It is desirable that the surface treatment liquid is highly wettable with respect to the object 200. It is desirable that the surface treatment liquid remains on the object 200 in a certain period of time after being ejected. Specifically, it is desirable that the surface treatment liquid has a high boiling point and a low vapor pressure property. It is desirable that the surface treatment liquid has conductivity ($10^6\Omega$/sq or more and $10^{11}\Omega$/sq or less) to the extent that static electricity can be removed. Thus, it is possible to have a charge removing effect on the surface of the object 200. In addition, it is desirable that the surface treatment liquid does not leave solids or the like after volatilization.

In this example, a volatile material is used for the first liquid droplet 147. Specifically, a mixed liquid of ethanol and water is used for the first liquid droplet 147. By using the first liquid droplet 147, the surface of the object 200 can be appropriately neutralized, and the wettability for the surface of the object 200 can be improved.

The first liquid droplet 147 may include various kinds of alcohols, a mixed solution of the various kinds of alcohols and water, or a ketone and ether-based organic solvents with volatile properties other than alcohol in addition to water, ethanol, and a mixture of ethanol and water as a volatile material.

The ejection amount of the first liquid droplet 147 is not particularly limited, but is preferably such that the wettability in the object 200 can be improved and the charge on the surface of the object 200 can be removed. Specifically, in the case of a mixed liquid in which ethanol and water are mixed at 1:1, it is preferable that a coating amount per 1 square centimeters is 0.01 μl or more and 1 μl or less as. In this case, thickness of the formed first liquid droplet 147 is 0.1 μm or more and 10 μm or less.

The region in which the first liquid droplet 147 is ejected is desirably larger than size of the pattern formed by the second liquid droplet 157. This allows the second liquid droplet 157 to adhere more stably to the object 200.

Figure 4:
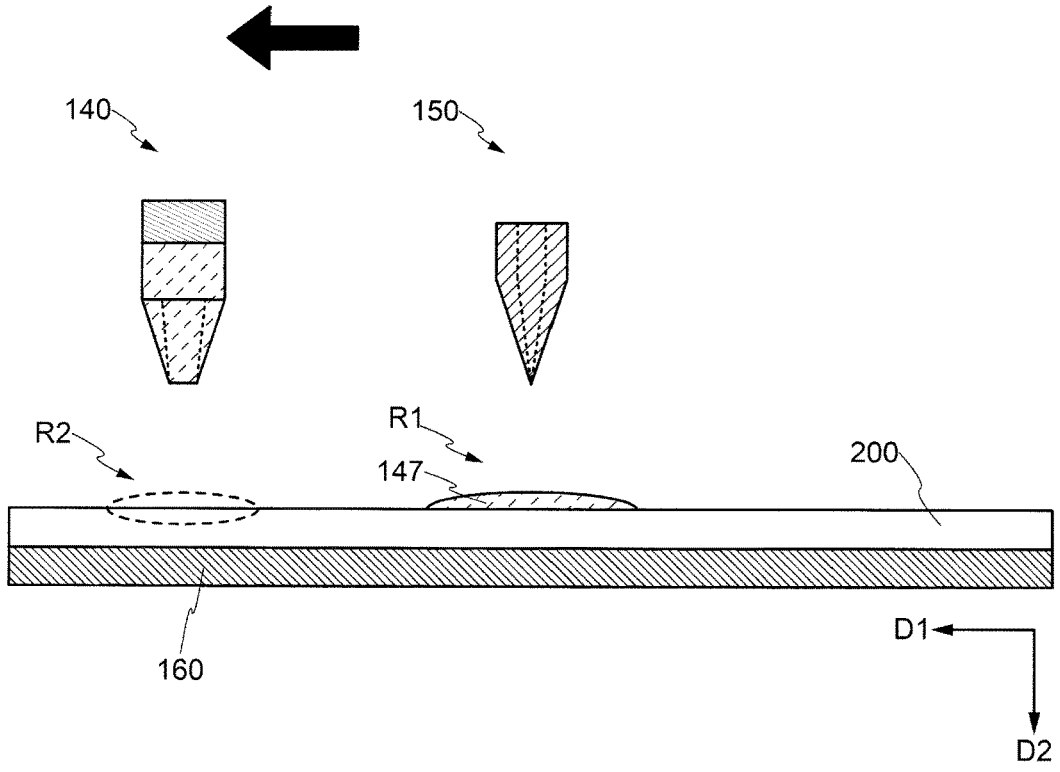
FIG. 4 is a cross-sectional view of a liquid droplet ejection method according to an embodiment of the present disclosure.

Next, as shown in FIG. 4, the first liquid droplet ejection unit 140 moves from the first region R1 to a second region R2 on the object 200. The second liquid droplet ejection unit 150 moves onto the first region R1 on which the first liquid droplet 147 is ejected, in accordance with the movement of the first liquid droplet ejection unit 140. The moving speeds of the first liquid droplet ejection unit 140 and the second liquid droplet ejection unit 150 are desirably set in advance to such an extent that the wettability on the subject can be maintained considering an elapsed time after the first liquid droplet 147 is ejected, an drying speed of the first liquid droplet 147, a distance between the first liquid droplet ejection unit 140 and the second liquid droplet ejection unit 150, and the like. In this case, it can be said that the first liquid droplet ejection unit 140 and the second liquid droplet ejection unit 150 move in the direction D1.

Figure 5:
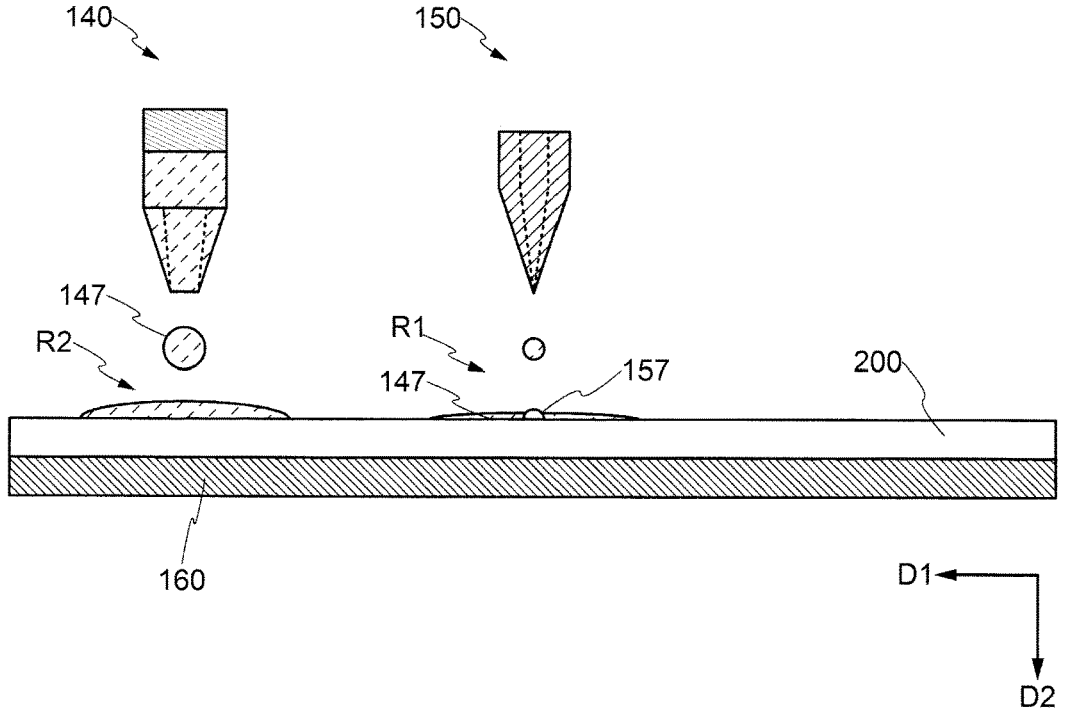
FIG. 5 is a cross-sectional view of a liquid droplet ejection method according to an embodiment of the present disclosure.

Next, as shown in FIG. 5, the first liquid droplet ejection unit 140 ejects the first liquid droplet 147 onto the second region R2 on the object 200 in the same manner as the first region R1. The second liquid droplet ejection unit 150 ejects the second liquid droplet 157 onto the first region R1 in synchronization with the first liquid droplet ejection unit 140. In this example, the second liquid droplet ejection unit 150 ejects the second liquid droplet 157 at the same time as the first liquid droplet ejection unit 140 ejects the first liquid droplet 147.

A material with a higher viscosity than the first liquid droplet 147 is used for the second liquid droplet 157. Specifically, an ink (also referred to as a second liquid) for forming a pattern containing a pigment is used for the second liquid droplet 157. The second liquid droplet 157 may include a conductive grain. The second liquid droplet ejection unit 150 includes an electrostatic ejection type inkjet, and the ejection amount of the second liquid droplet 157 is controlled by a voltage applied from the power supply unit 120. It is desirable that the ejection amount of the second liquid droplet 157 is 0.1 fl or more and 100 μpl or less. The pattern size in the present embodiment is 100 nm or more and 500 μm or less.

The first region R1 in which the second liquid droplet 157 is ejected is in a state in which the first liquid droplet 147 is volatilized, and does not remain or remains slightly on the surface of the object. In this case, the surface of the first region R1 is electrostatically discharged and have good wettability (lyophilic). Thus, when the second liquid droplet 157 is ejected onto the first region R1, it is possible to have good adhesion to the surface of the object 200. Therefore, the second liquid droplet 157 is disposed at a predetermined position.

Figure 6:
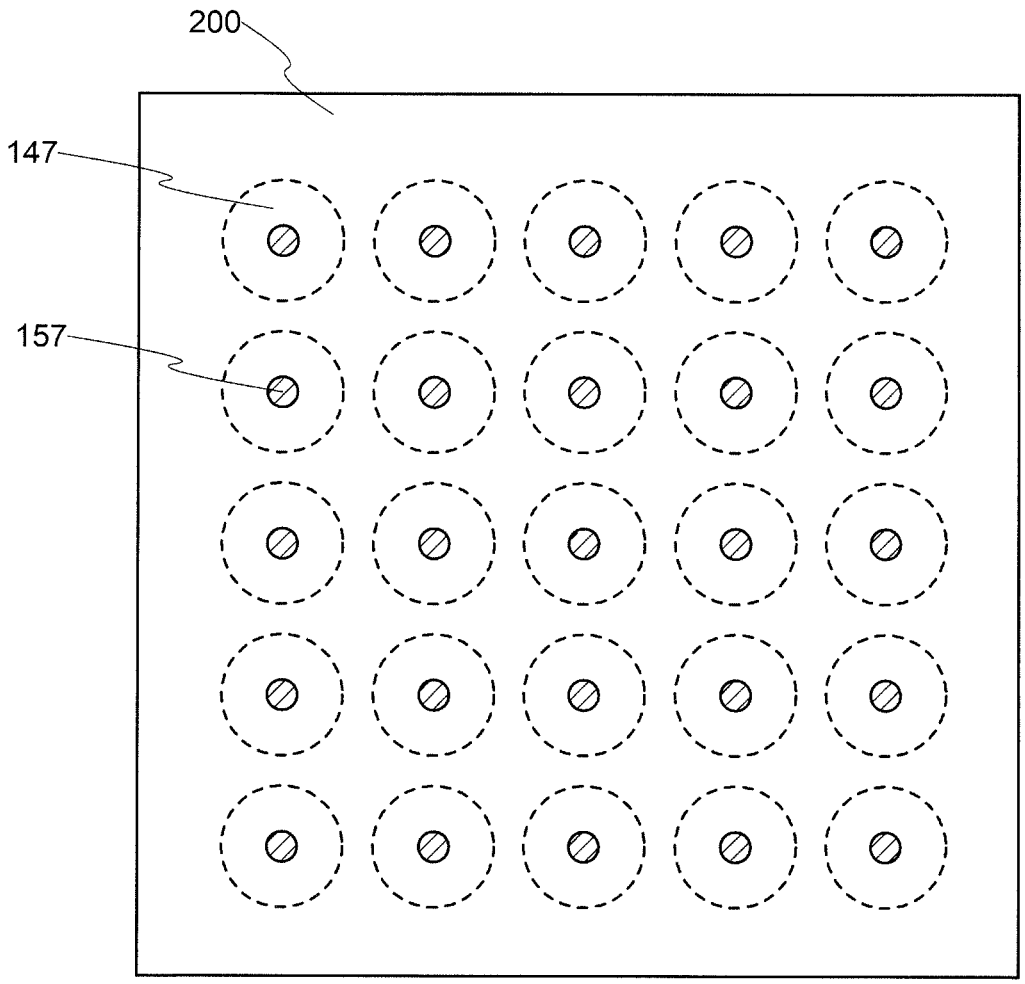
FIG. 6 is a top view of patterns formed by a liquid droplet ejection method according to an embodiment of the present disclosure.

The first liquid droplet ejection unit 140 and the second liquid droplet ejection unit 150 repeat the above processes to perform the desired liquid droplet ejection. FIG. 6 is a top view of the object 200 after the liquid droplet ejection. As shown in FIG. 6, the pattern (second liquid droplet 157) is disposed at a desired position on the object 200. In this case, the first liquid droplet 147 may be volatilized or may remain partially.

Here, comparing the present disclosure with the prior art, in the prior art, a plasma treatment or a UV ozone treatment has been used to eliminate static electricity on the surface of the object 200. However, by using this embodiment, the second liquid droplet 157 can be stably deposited at a predetermined position on the surface of the object 200. In other words, the liquid droplets can be easily and stably ejected onto the surfaces of the object 200. By using this embodiment, it is not necessary to perform the plasma treatment, so that the damage to object can be reduced.

Second Embodiment

In the present embodiment, examples in which a step 170 is provided on the surface of the object 200 is described with reference to the drawings.

Figure 7:
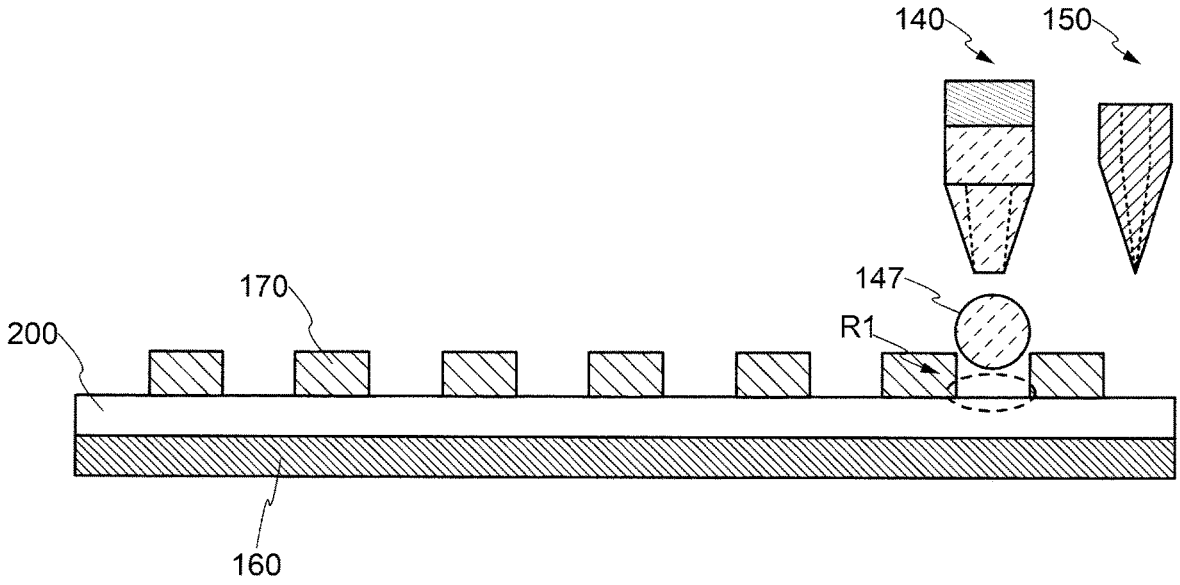
FIG. 7 is a cross-sectional view of a liquid droplet ejection method according to an embodiment of the present disclosure.

First, as shown in FIG. 7, the first liquid droplet ejection unit 140 and the second liquid droplet ejection unit 150 are moved and disposed on the object 200 having the step 170. The step 170 (also referred to as a pattern or convex part) on the surface of the object 200 is provided as an organic insulating layer. The organic insulating layer used for the step 170 is not particularly limited. In this example, a polyimide resin is used for the step 170. The organic insulating layer may be formed of other organic resin such as an acrylic resin or an epoxy resin, or an inorganic material. In this embodiment, the step 170 is provided in the shape of a grid (also referred to as a parallel cross structure) so as to expose a part of the surface on the object 200. Each of the first region R1 and the second region R2 is surrounded by the step 170.

Figure 8:
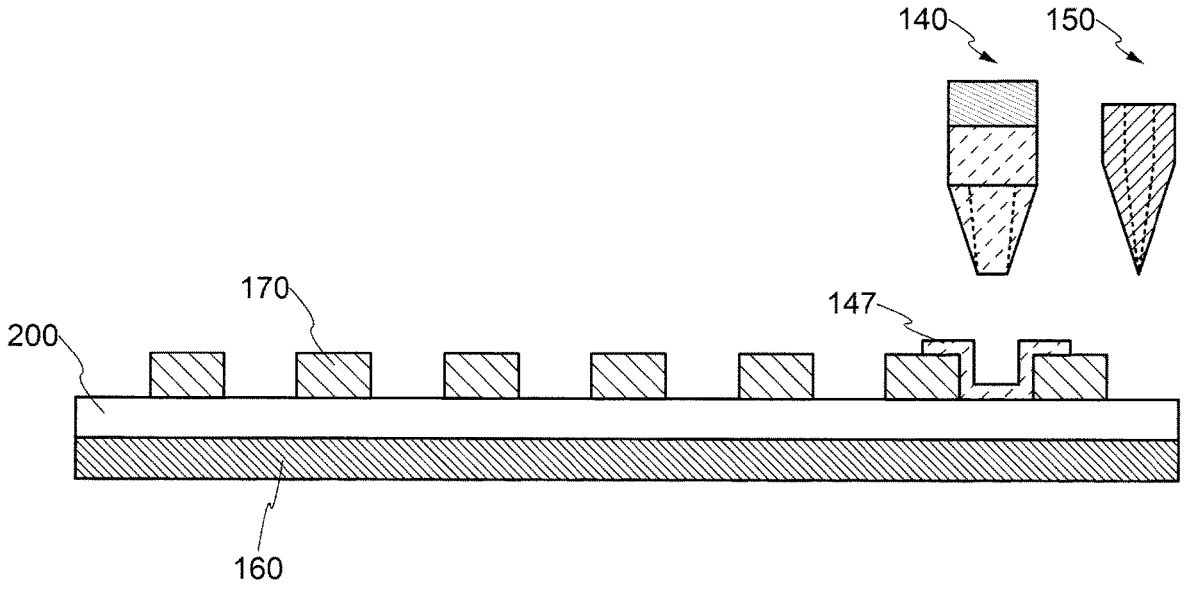
FIG. 8 is a cross-sectional view of a liquid droplet ejection method according to an embodiment of the present disclosure.

In this case, the first liquid droplet ejection unit 140 is arranged on the first region R1. The first liquid droplet ejection unit 140 ejects the first liquid droplet 147 onto the first region R1 (more specifically, at a predetermined position within the first region R1). As shown in FIG. 8, the first liquid droplets 147 are ejected onto the surfaces of the step 170 and the object 200.

Figure 9:
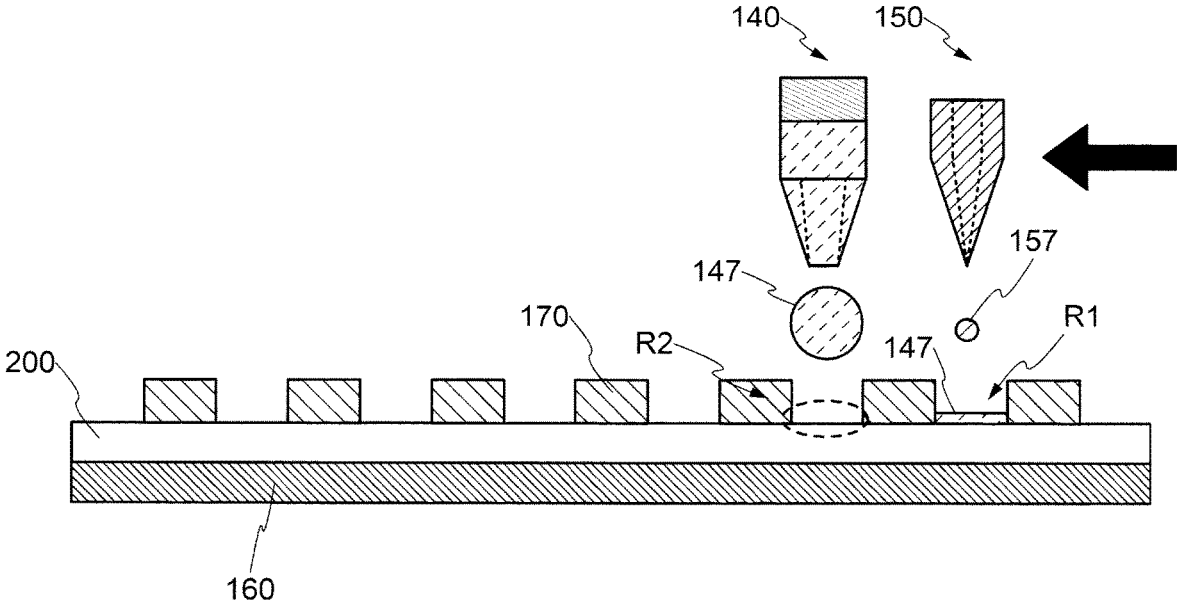
FIG. 9 is a cross-sectional view of a liquid droplet ejection method according to an embodiment of the present disclosure.

Next, the first liquid droplet ejection unit 140 moves from the first region R1 to the second region R2 on the object 200. The second liquid droplet ejection unit 150 moves onto the first region R1 where the first liquid droplet 147 was ejected. In this case, the first liquid droplet 147 attempts to minimize the surface area by surface tension. When there is a region surrounded by such a parallel cross structure, the first liquid droplet 147 attempts to minimize the area of the interface with the air by retracting into the region. Further, the evaporation rate of the first liquid droplet 147 is faster as the thickness of the first liquid droplet 147 is thinner. Therefore, the first liquid droplet 147 of the region (inside of the parallel cross structure) surrounded by the step evaporates slowly, and the liquid on the step 170 dries quickly. Therefore, as shown in FIG. 9, after a predetermined period of time has elapsed, the first liquid droplet 147 exists only in the region (inside of the parallel cross structure) surrounded by the step 170. The first liquid droplet 147 is repelled from the step 170 in the first region R1 and remains only on the object 200.

Similar to the first region R1, the first liquid droplet ejection unit 140 ejects the first liquid droplet 147 onto the second region R2 of the object 200. The second liquid droplet ejection unit 150 ejects the second liquid droplet 157 onto the first region R1 in synchronized with the first liquid droplet ejection unit 140. In this example, the second liquid droplet ejection unit 150 ejects the second liquid droplet at the same time as the first liquid droplet ejection unit 140 ejects the first liquid droplet. In this case, the second liquid droplet 157 may be ejected in the situation in which the first liquid droplet 147 remains on the surface of the first region R1 in the object 200.

Figure 10:
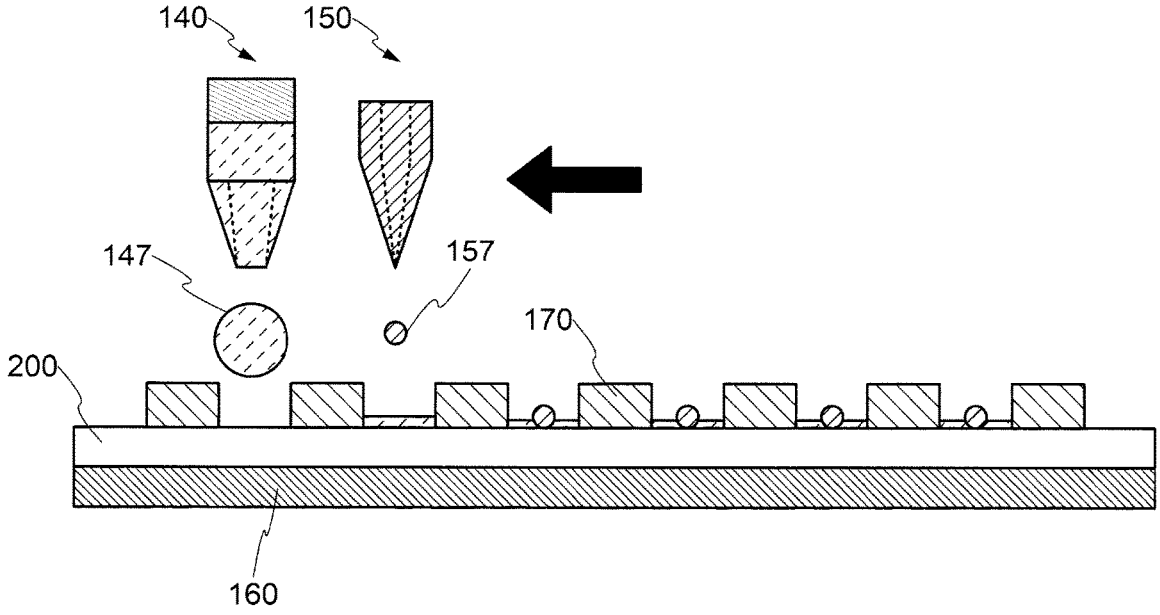
FIG. 10 is a cross-sectional view of a liquid droplet ejection method according to an embodiment of the present disclosure.

The first liquid droplet ejection unit 140 and the second liquid droplet ejection unit 150 repeat the above-described process. As shown in FIG. 10, the second droplets 157 are ejected not on the step 170, but only on the surface of the object 200.

In the present embodiment, when the second liquid droplet 157 is ejected, the first liquid droplet 147 remains only on the surface (specifically, inside the parallel cross structure) of the object 200. This suppresses electrostatic charging on the object 200 and improves the wettability on the surface of the object 200. Therefore, the second liquid droplet 157 is easily landed on the surface of the object 200 preferentially, and the second liquid droplet 157 can be stably ejected without being affected by the step 170.

Also, when there is the first liquid droplet 147 having the conductive inside of the parallel cross structure, an electric field line is concentrated in the portion. This makes it easier for the second liquid droplet 157 (ink) to land on the inside of the parallel cross structure. That is, the second liquid droplet 157 can be ejected to a desired position.

Figure 11:
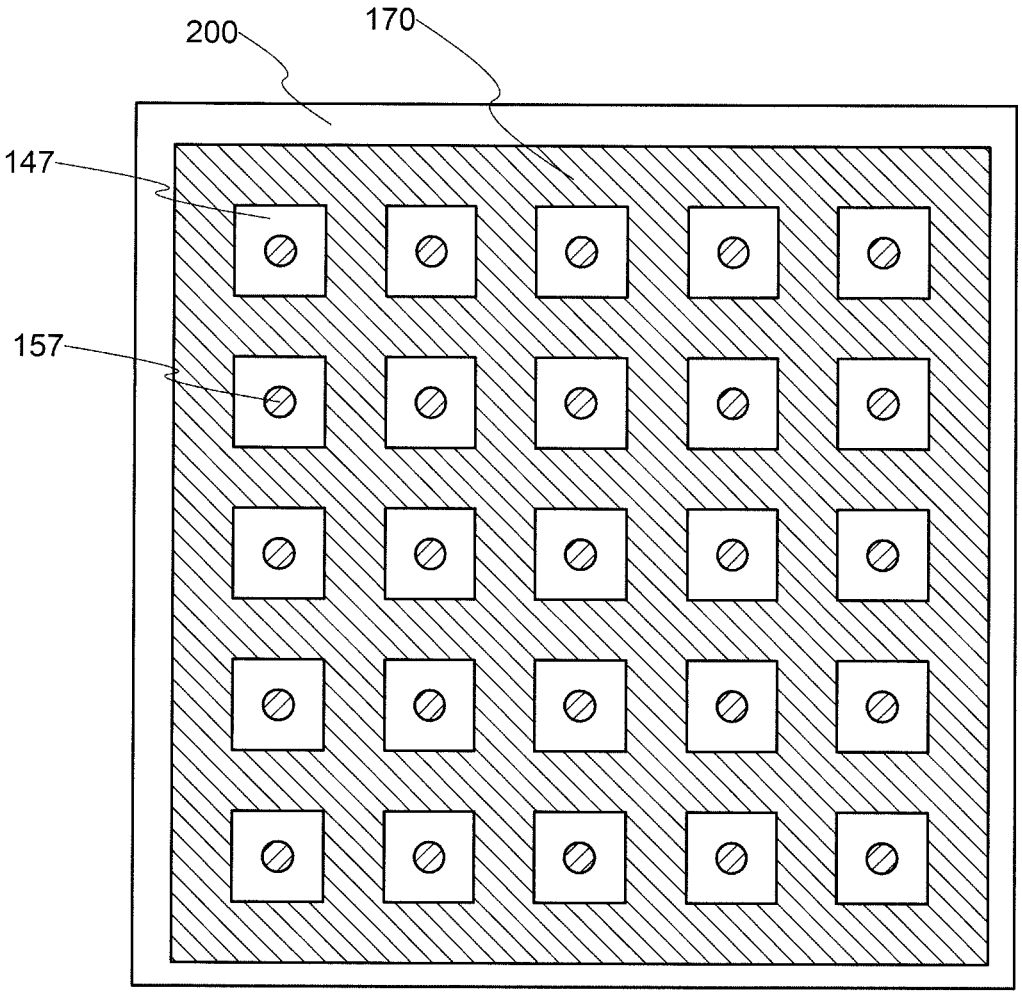
FIG. 11 is a top view of patterns formed by a liquid droplet ejection method according to an embodiment of the present disclosure.

From the above, by using the present embodiment, the electrostatic charging of the object itself is removed, and the effect of the step 170 applied to the object is alleviated. Thus, as shown in FIG. 11, in the case in which the step 170 is provided on the surface of object 200, the second liquid droplet 157 can be stably ejected and desired patterns can be formed. The first liquid droplet 147 may remain on the object 200 after patterning by the second liquid droplet 157.

Third Embodiment

In the present embodiment, a liquid droplet ejection device differing from the first embodiment is described. Specifically, an example in which a liquid droplet ejection device includes a plurality of first liquid droplet nozzles 141 and a plurality of second liquid droplet nozzles 151 will be described. For the sake of explanation, members thereof is omitted as appropriate.

[3-1. Configuration of the Liquid Droplet Ejection Device 100]

Figure 12:
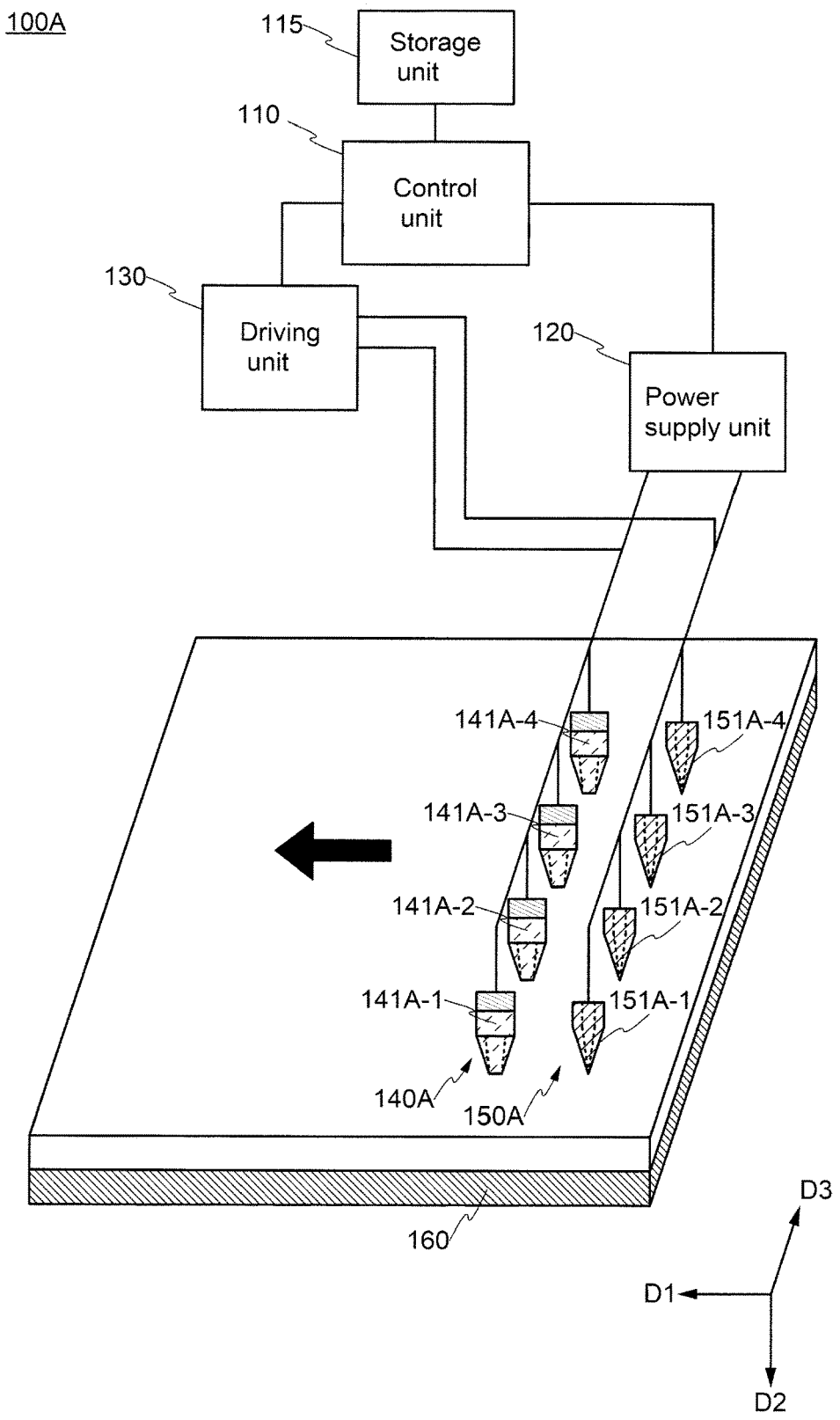
FIG. 12 is a schematic view of a liquid droplet ejection device according to an embodiment of the present disclosure.

FIG. 12 is a schematic view of a liquid droplet ejection device 100A according to an embodiment of the present disclosure. The liquid droplet ejection device 100A includes the control unit 110, the storage unit 115, the power supply unit 120, the driving unit 130, a first liquid droplet ejection unit 140A, and a second liquid droplet ejection unit 150A.

In the present embodiment, a plurality of first liquid droplet ejection unit 140A are provided in direction (specifically, D3 direction orthogonal to the D1 direction) intersecting with respect to the direction (in this case, the D1 direction) in which the first liquid droplet ejection unit 140A moves (specifically, the first liquid droplet ejection unit 140A includes a first liquid droplet nozzle 141A-1, 141A-2, 141A-3, and 141A-4, each arranged independently). Similarly, a plurality of second liquid droplet ejection unit 150A are provided in direction intersecting with respect to the direction in which the first liquid droplet ejection unit 140A and the second liquid droplet ejection unit 150A move (more specifically, the second liquid droplet ejection unit 150A includes a second liquid droplet nozzle 151A-1, 151A-2, 151A-3, and 151A-4, each arranged independently). In the present embodiment, by having the first liquid droplet ejection unit 140A and the second liquid droplet ejection unit 150A, the process duration of the liquid droplet ejection can be shortened.

In the present embodiment, an example in which the plurality of first liquid droplet ejection unit 140A is shown, but the present disclosure is not limited thereto. The first liquid droplet ejection unit 140A does not need to have a precise positional accuracy, and thus may have different shape.

Figure 13:
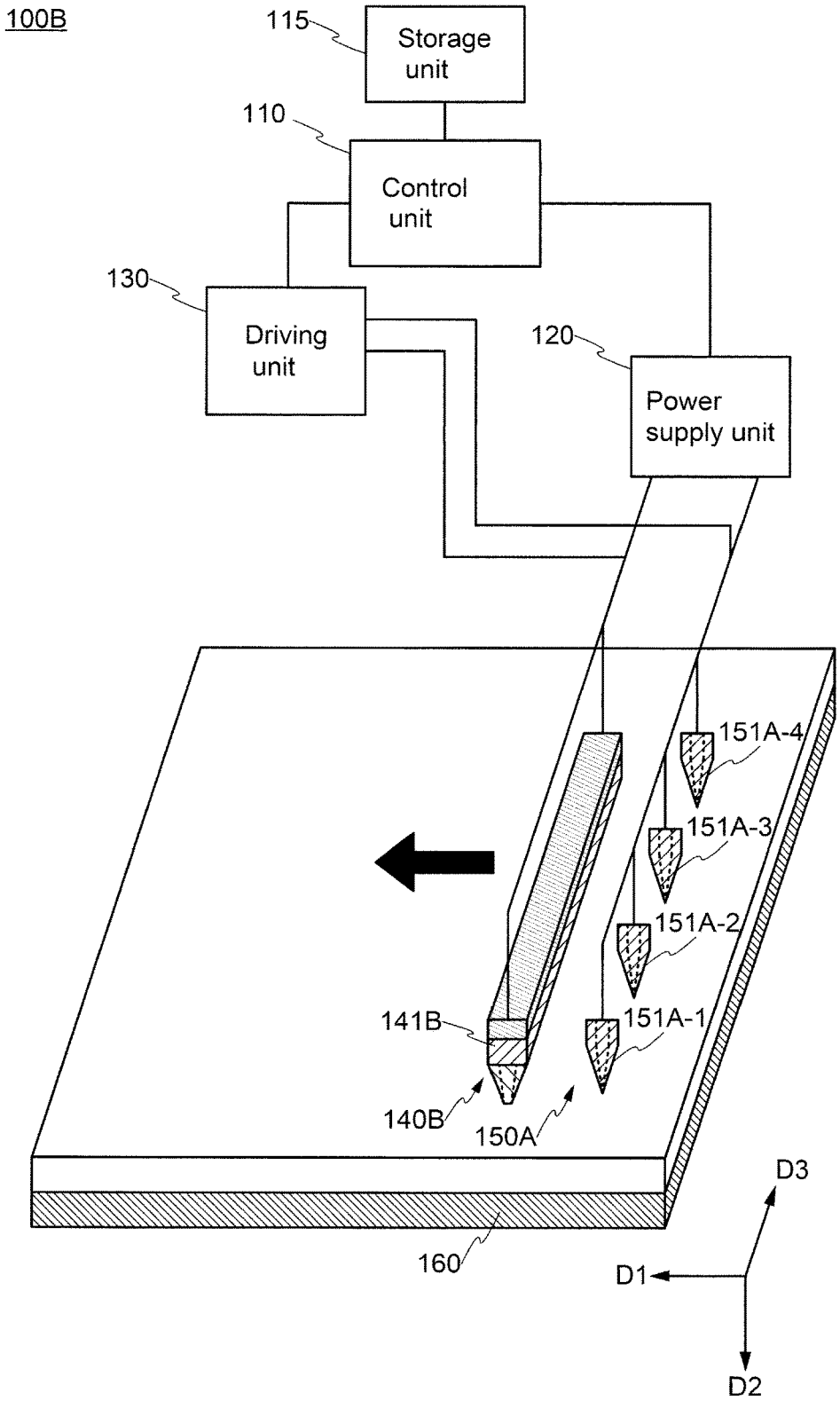
FIG. 13 is a schematic view of a liquid droplet ejection device according to an embodiment of the present disclosure.
Figure 14:
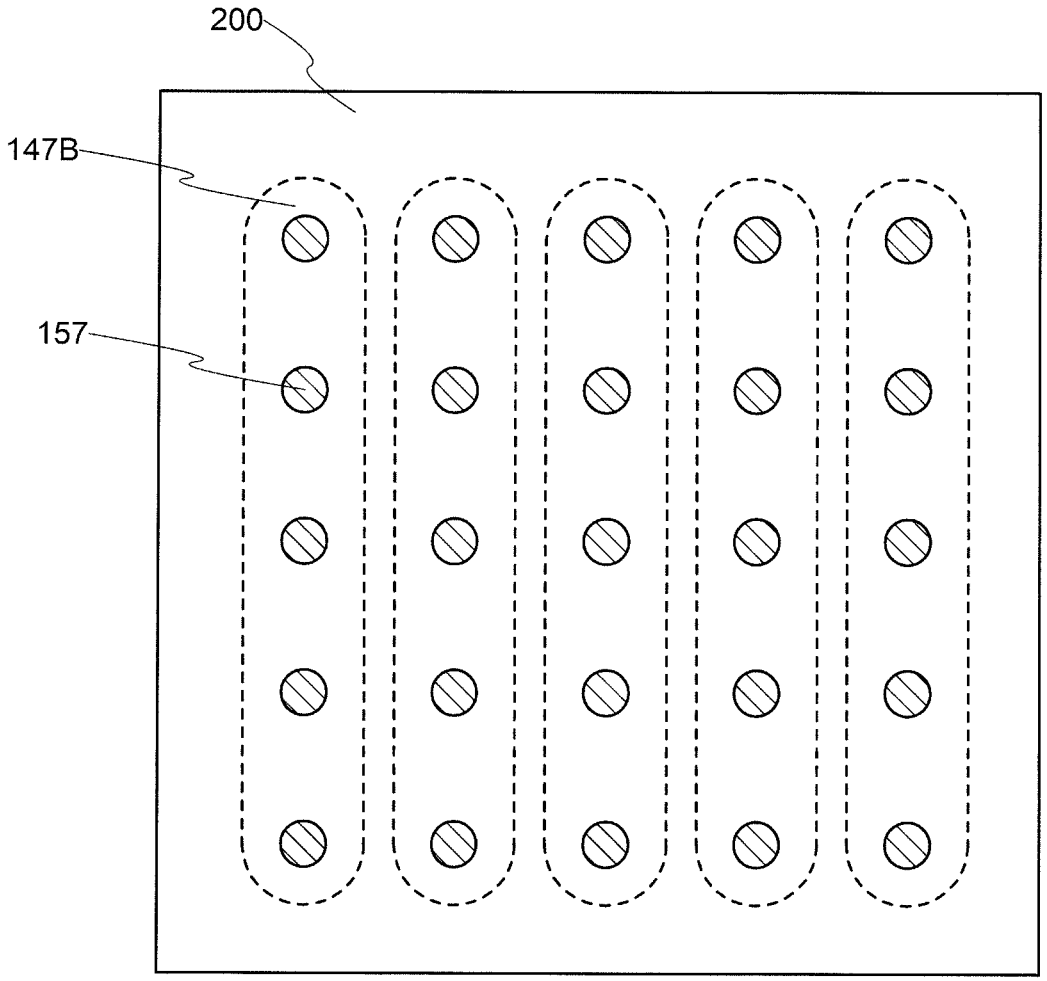
FIG. 14 is a top view of patterns formed by a liquid droplet ejection method according to an embodiment of the present disclosure.

FIG. 13 is a schematic view of a liquid droplet ejection device 100B according to an embodiment of the present disclosure. In the liquid droplet ejection device 100B, a first liquid droplet nozzle 141B in a first liquid droplet ejection unit 140B may extend in a direction (specifically D3 direction) intersecting the direction in which the first liquid droplet ejection unit 140B moves (in this case D1 direction). Specifically, as shown in FIG. 13, the first liquid droplet nozzle 141 may have a slit-shape. In this instance, the first liquid droplets 147 are ejected from the first liquid droplet nozzle 141 in a row. In this case, in the top view of patterns to be formed, as shown in FIG. 14, the first liquid droplets 147 may be provided in a row, and the second liquid droplets 157 may be provided at predetermined positions apart from each other.

Figure 15:
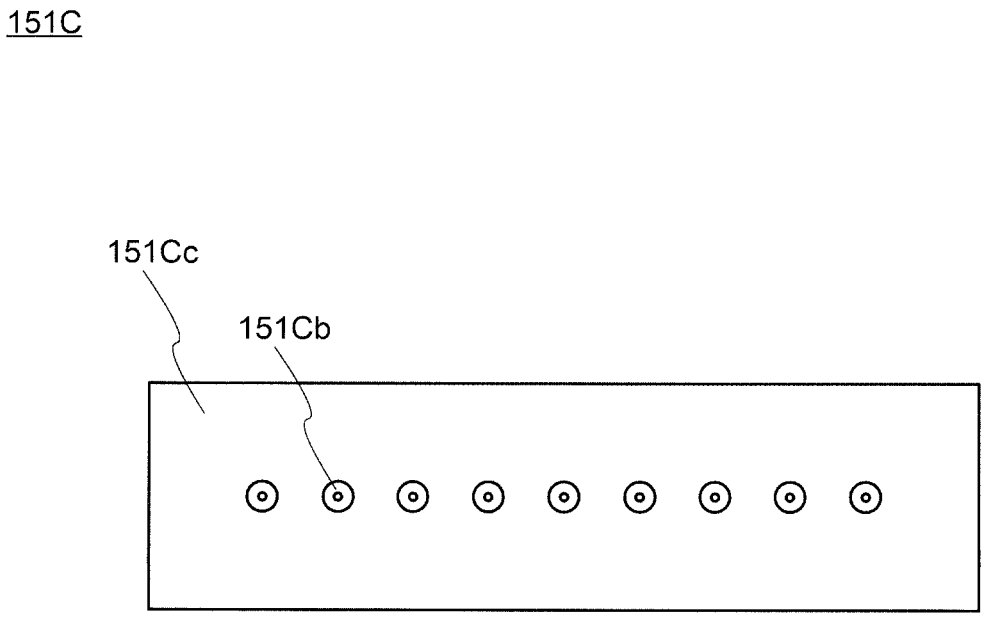
FIG. 15 is a top view of a second liquid droplet nozzle according to an embodiment of the present disclosure.
Figure 16A:
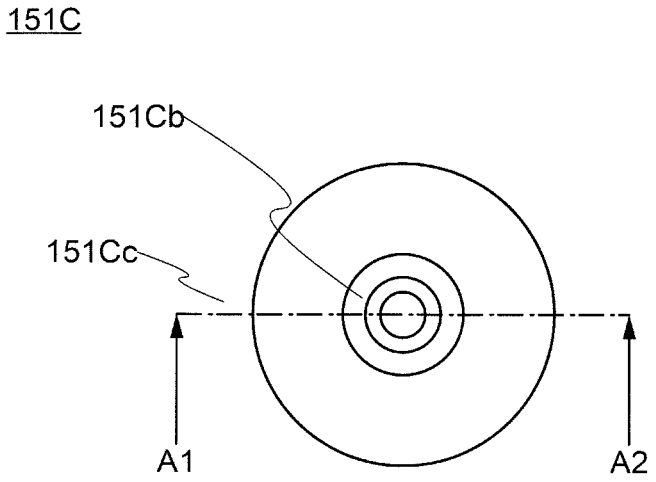
FIG. 16A is an enlarged top view of a second liquid droplet nozzle according to an embodiment of the present disclosure.
Figure 16B:
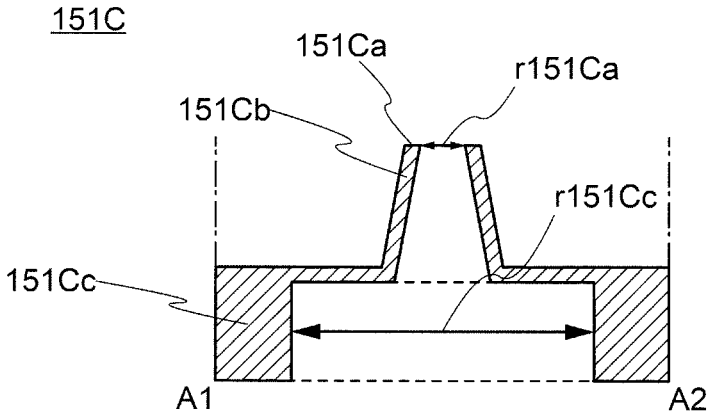
FIG. 16B is a cross-sectional view of a second liquid droplet nozzle according to an embodiment of the present disclosure.

In the present embodiment, an example in which a plurality of second liquid droplet nozzle 151A are independently each provided in the second liquid droplet ejection unit 150 A is shown, but the present disclosure is not limited thereto. FIG. 15 is a top view of a second liquid droplet nozzle 151C. FIG. 16A is an enlarged top view of a part in the second liquid droplet nozzle 151C. FIG. 16B is a cross-sectional view of a part in the second liquid droplet nozzle 151C. As shown in FIGS. 15 and 16, the second liquid droplet nozzle 151C has a plurality of nozzle units 151Cb and plate units 151Cc. In this example, a plurality of nozzle units 151Cb are arranged in a row but may be arranged in a plurality of rows.

A metal material such as nickel is used for the nozzle unit 151Cb. The nozzle unit 151Cb is formed to be tapered by, for example, an electroforming process. A metal material such as stainless steel is used for the plate unit 151Cc. The plate unit 151Cc has a hole having an inner diameter r151Cc larger than the inner diameter r151Ca of the ejection port (nozzle tip 151Ca) in the nozzle unit 151Cb in a portion overlapping with the nozzle unit 151Cb. The nozzle unit 151Cb may be welded to the plate unit 151Cc or may be fixed by an adhesive. When the second liquid droplet nozzle 151C is used, a voltage may be applied to the nozzle 151Cb, or a voltage may be applied to the plate unit 151Cc (or the second ink tank 153).

A person of ordinary skill in the art would readily conceive various alterations or modifications of the present disclosure, and such alterations and modifications are construed as being encompassed in the scope of the present disclosure. For example, the devices in the above-described embodiments may have an element added thereto, or deleted therefrom, or may be changed in design optionally by a person of ordinary skill in the art. The methods in the above-described embodiments may have a step added thereto, or deleted therefrom, or may be changed in the condition optionally by a person of ordinary skill in the art. Such devices and methods are encompassed in the scope of the present disclosure as long as including the gist of the present disclosure.

[Modification]

In the first embodiment of the present disclosure, an example in which the first liquid droplet ejection unit 140 and the second liquid droplet ejection unit 150 move on the object 200 by the driving unit 130 is shown, but the present disclosure is not limited thereto. For example, in the liquid droplet ejection device, the driving unit 130 may move the object 200. In this instance, the first liquid droplet ejection unit 140 and the second liquid droplet ejection unit 150 may be fixed in the same position.

In the first embodiment, the piezo type inkjet nozzle is used for the first liquid droplet nozzle 141 of the first liquid droplet ejection unit 140, but the present disclosure is not limited thereto. A spraying nozzle may be used for the first liquid droplet ejection unit 140. When the spray nozzle is used, the first liquid droplet 147 can be ejected or sprayed over a wide area of the object 200.

In the first embodiment of the present disclosure, an example in which the first liquid droplet nozzle 141 is provided perpendicularly to the surface of the object 200 is shown, but the present disclosure is not limited thereto. The first liquid droplet nozzle 141 may have an inclination with respect to the direction perpendicular to the object 200. The same applies to the second liquid droplet nozzle 151 of the second liquid droplet ejection unit 150.

In the first embodiment of the present disclosure, an example has been shown in which a material having volatility is used for the first liquid droplet 147, but the present disclosure is not limited thereto. For example, an antistatic agent may be used for the first liquid droplet 147. In this case, it is desirable that the surface resistance value of the first liquid droplet 147 is $10^6\Omega$/sq or more and $10^{11}\Omega$/sq or less. The antistatic agent may not have volatility and may remain partially on the surface of the object 200

In the first embodiment of the present disclosure, an example in which the organic insulating layer is used as a step is shown, but the present disclosure is not limited thereto. For example, the step may be a wiring pattern, or an inorganic material may be used as the step. The object 200 itself may be processed to provide a step. The object 200 may be a wiring substrate in which wiring is laminated.

When the second liquid droplet 157 is ejected in the first embodiment of the present disclosure, an image may be taken by using an imaging device. In this instance, the imaging result may be determined by the control unit 110. When the control unit 110 determines that there is an ejection failure, the control unit 110 may eject the first liquid droplet 147 and the second liquid droplet 157 again on the failure occurrence region. As a result, it is possible to suppress the liquid droplet ejection failure.

In the first embodiment of the present disclosure, an example has been described in which the first liquid droplet and the second liquid droplet are simultaneously ejected when the first liquid droplet and the second liquid droplet are synchronously ejected, but the present disclosure is not limited thereto. For example, the first liquid droplet and the second liquid droplet may not be ejected simultaneously, but the second liquid droplet may be ejected after the first liquid droplet has been ejected and a predetermined period of time elapsed. The first liquid droplet and the second liquid droplet may be ejected in conjunction with each other.

The invention claimed is:

1. A liquid droplet ejection device comprising:

at least one first liquid droplet ejection unit including a first liquid holding unit and a first tip, the first liquid holding unit configured to hold a first liquid, and the first tip configured to eject the first liquid in the first liquid holding unit as a first liquid droplet configured to treat a surface of an object;

at least one second liquid droplet ejection unit including a second liquid holding unit and a second tip, the second liquid holding unit configured to hold a second liquid, and the second tip configured to eject the second liquid in the second liquid holding unit as a second liquid droplet differing from the first liquid droplet configured to form a pattern on the object;

an object holding unit configured to hold the object; and a driving unit configured to move the first tip and the second tip in a first direction relative to the object holding unit, wherein the first tip is arranged in the first direction relative to the second tip, and the second liquid droplet is more viscous than the first liquid droplet.

2. The liquid droplet ejection device according to claim 1, wherein the at least one first liquid droplet ejection unit includes a plurality of first liquid droplet ejection units arranged in a direction intersecting with respect to a direction in which the first liquid droplet ejection unit moves.

3. The liquid droplet ejection device according to claim 1, wherein the at least one first liquid droplet ejection unit extends in a direction intersecting with respect to a direction in which the at least one first liquid droplet ejection unit moves.

4. The liquid droplet ejection device according to claim 2, wherein the at least one second liquid droplet ejection unit includes a plurality of second liquid droplet ejection units arranged in a direction intersecting with respect to a direction in which the at least one first liquid droplet ejection unit moves.

5. The liquid droplet ejection device according to claim 1, wherein an inner diameter of the first tip in the at least one first liquid droplet ejection unit is larger than an inner diameter of the second tip in the at least one second liquid droplet ejection unit.

6. The liquid droplet ejection device according to claim 5, wherein the at least one first liquid droplet ejection unit has a piezo type nozzle head, and the at least one second liquid droplet ejection unit has an electrostatic ejection type nozzle head.

7. A liquid droplet ejection method comprising:

ejecting a first liquid droplet for surface treatment from a first liquid droplet ejection unit onto a first region of an object;

ejecting a second liquid droplet for forming a pattern from a second liquid droplet ejection unit onto the first region, the second liquid droplet being more viscous than the first liquid droplet, and the second liquid droplet ejection unit different from the first liquid droplet ejection unit; and ejecting the first liquid droplet from the first liquid droplet ejection unit onto a second region in synchronized with ejecting the second liquid droplet from the second liquid droplet ejection unit, the second region being different from the first region.

8. The liquid droplet ejection method according to claim 7, wherein the second liquid droplet is ejected in response to a predetermined condition being satisfied.

9. The liquid droplet ejection method according to claim 8, wherein the predetermined condition includes an information related to an elapsed time after the first liquid droplet was ejected to the first region, or an information related to a thickness of the first liquid droplet.

10. The liquid droplet ejection method according to claim 7, wherein the region in which the first liquid droplet is ejected is larger than a pattern size formed by the second liquid droplet.

11. The liquid droplet ejection method according to claim 10, wherein the pattern size formed by the second liquid droplet is 100 nm or more and 500 μm or less.

12. The liquid droplet ejection method according to claim 7, wherein the first liquid droplet has volatility.

13. The liquid droplet ejection method according to claim 7, wherein a surface resistance of the first liquid droplet is $10^6\Omega/sq$ or more and $10^{11}\Omega/sq$ or less.

* * * * *